United States Patent [19]

Carter

[11] 4,226,660

[45] Oct. 7, 1980

[54] DOCTOR BLADE FOR LABELING MACHINE

[75] Inventor: Sidney T. Carter, Shrewsbury, Mass.

[73] Assignee: A-T-O Inc., Willoughby, Ohio

[21] Appl. No.: 42,040

[22] Filed: May 24, 1979

[51] Int. Cl.[3] ..... B65C 9/08; B65C 11/04

[52] U.S. Cl. ..... 156/357; 156/571; 156/578

[58] Field of Search ..... 156/356, 357, 571, 578

[56] References Cited

U.S. PATENT DOCUMENTS

| | | | |
|---|---|---|---|
| 3,045,643 | 7/1962 | Mattingly | 156/356 |
| 3,522,134 | 7/1970 | Von Hofe | 156/357 |
| 3,546,047 | 12/1970 | Dulunger | 156/571 |
| 4,060,229 | 11/1977 | Carter | 156/568 |

*Primary Examiner*—Douglas J. Drummond
*Attorney, Agent, or Firm*—Robert T. Gammons

[57] ABSTRACT

In a labeling machine the combination with a glue applying roll, pickers and a label magazine from which labels are picked by the picker when the latter has on its surface a layer of glue of a doctor blade supported with an edge at a distance from the surface of the glue applying roll which will provide adequate glue for labeling and pneumatically-operable means operable to retract the label magazine from the path of movement of the pickers when there is a gap in the procession of containers or no containers and simultaneously to move the doctor blade closer to the surface of the glue applying roll to reduce the amount of glue on the surface of the glue applying roll available to the pickers without removing all of the glue.

7 Claims, 9 Drawing Figures

DOCTOR BLADE FOR LABELING MACHINE

BACKGROUND OF THE INVENTION

In the labeling machine shown in my U.S. Pat. No. 4,060,229 there is a glue applying roll, a label magazine and picker so arranged that the picker moves along a path to first receive glue from the glue applying roll, then engage a label in the label magazine from which it removes the label and transfers it to a transfer drum whereupon the latter applies the glue coated label to a container. When a gap occurs in the procession of containers or a run of containers has been completed so that there are no containers, it is customary to retract the label magazine to avoid wasting labels. Since no labels are being picked, the glue which would ordinarily have been removed from the pickers is not so removed and builds up in excess on the pickers. Hence, when the labeling operation is resumed, the first few labels will have an excessive amount of glue. Furthermore, because the pickers are rotating at a relatively high speed, the centrifugal force throws the excess glue off onto adjacent parts. To avoid this, it is customary when there is a gap in the procession of containers or no containers to stop the apparatus and wait. When the procession of containers is resumed, the labeling instrumentalities are restarted to allow the glue to build up on the surface of the glue applying roll in the proper amount to stick the labels to the containers. This is a critical operation and an operator must learn how to run the apparatus to make the proper adjustments to provide for the correct thickness of glue, otherwise the labels will not stick. It is the purpose of this invention to avoid the foregoing difficulties and the risk that an operator will not make the proper adjustment by automatically reducing the thickness of glue on the faces of the pickers, that is, to prevent a buildup of glue on them without completely removing the glue therefrom by reducing the thickness of the glue on the surface of the glue applying roll and when the labeling operation is resumed, to restore the required thickness of glue to the labeling instrumentalities.

SUMMARY OF INVENTION

As herein illustrated, the invention comprises in a labeling machine in combination with a glue applying roll, a picker and a label magazine from which labels are picked by the picker when the latter has on its surface a layer of glue, a doctor blade supported with an edge in spaced parallel relation to the surface of the glue applying roll and means operable to retract the label magazine from the path of movement of the picker and simultaneously to move the doctor blade closer to the surface of the glue applying roll. The doctor blade is supported on a spindle, the axis of which is parallel to the axis of the glue applying roll for adjustment in a plane parallel to the axis of the glue applying roll to align its edge in parallelism with the surface of the glue applying roll and for rotation about the axis of the spindle to dispose it in one of two positions spaced from the surface of the glue applying roll to provide on the one hand a surface coating thereon of sufficient thickness to insure picking the labels from the magazine and for attaching them to the containers and on the other hand to reduce the thickness of the glue in the absence of labels to a minimal without entirely stripping the glue from the glue applying roll. Alignment of the edge of the doctor applying roll in parallelism with the surface of the glue applying roll is achieved by means of eccentric means and pivotal movement of the doctor applying roll is achieved by an air operated piston and cylinder assembly. A spring normally holds the doctor blade away from the surface at a selected predetermined spacing and the piston and cylinder assembly operate to move it toward the surface. The magazine is mounted for retractive movement from the path of the picker and legs pivoted, respectively, at their upper and lower ends to the magazine frame and to the base frame of the machine. A piston and cylinder assembly connected diagonally between the lower ends and upper ends of the legs pivots the legs angularly away from the path of movement of the picker. The latter piston and cylinder assembly is double-acting so that when air is supplied to retract the piston rod, air is exhausted at the other end to the piston and cylinder assembly which moves the blade relative to the glue applying roll.

The invention will now be described with reference to the accompanying drawings wherein.

Figure 1:
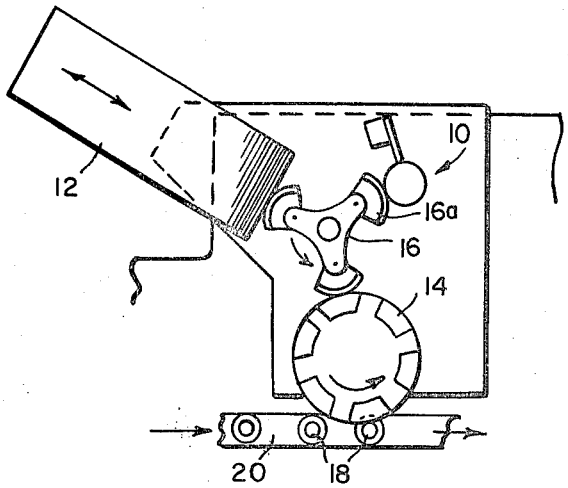
FIG. 1 is a plan view diagrammatically illustrating the components of a labeling machine by means of which adhesive is applied to labels and the latter are applied to a container such as a bottle.
Figure 2:
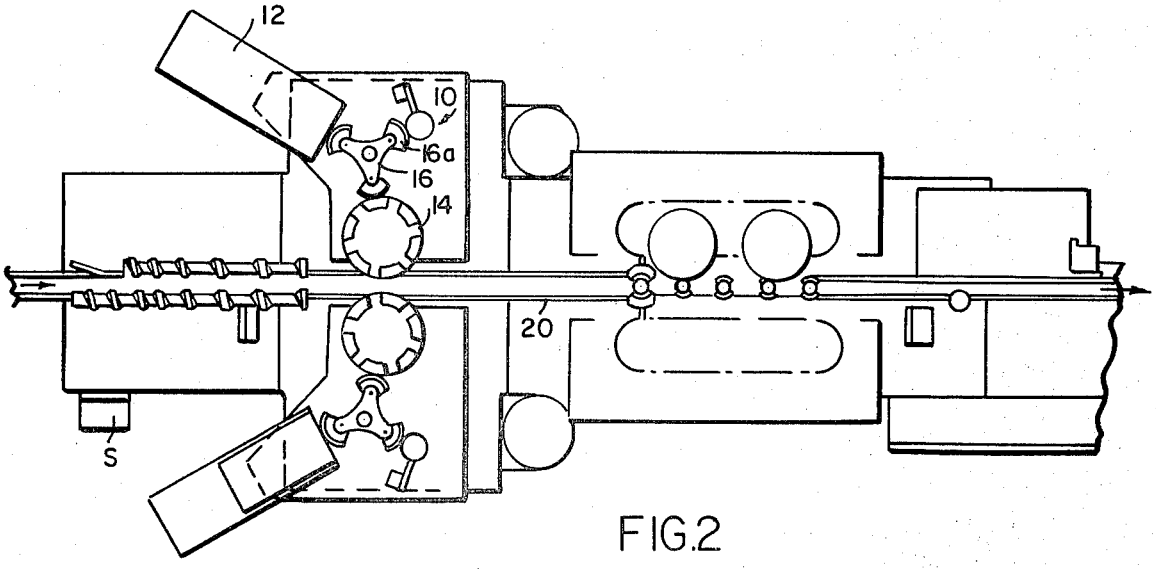
FIG. 2 is a plan view of a portion of a label applying machine showing an arrangement of the components shown in FIG. 1 at each side of a conveyor so as to enable applying labels to both sides of containers traveling along on the conveyor.

Referring to FIGS. 1 and 2, the doctor blade assembly as herein illustrated is for use with a labeling machine wherein a glue applying roll 10, label magazine 12 and transfer cylinder 14 are arranged around a picker 16 provided with shoes **16*a* which successively receive a coating of glue from the glue applying roll 10, remove labels from the label magazine 12 and transfer the glue coated labels to a transfer drum 14 which removes the glue applied labels from the picker shoes and applies them to containers 18, moving in succession along a conveyor 20**.

There are periods in the operation of the labeling machine when no containers or bottles are being labeled or where there is an interruption in the procession of the bottles and it is desirable during such periods to retract the label magazine so that labels will not be picked from the magazine by the rotating picker. In such machines, glue is supplied to the upper end of the glue applying roll and flows downwardly over the peripheral surface into a tray at the bottom of the label applying roll and is returned to a reservoir for reuse. Since it is the function of the pickers to remove a coating of glue from the glue applying roll and apply it to the surfaces of the labels which it picks from the label magazine, if the label magazine is retracted, the picker shoes will accumulate an excessive amount of glue, and when the labeling operation is resumed, the first few labels will have an excess amount of glue. Furthermore, during the interval between labeling operations, the excess glue on the surface of the pickers will be thrown off by the centrifugal action onto the surrounding machine parts. It is the purpose of this invention, as will now appear, to reduce the amount of glue on the glue applying roll when the label magazine is retracted for any length of time so that an excess amount of glue is not applied to the pickers with the aid of a doctor blade which is movable from a position in which it maintains a thickness of glue on the surface of the glue roll sufficient for labeling during a continuous labeling operation to a position closer to the glue roll for reducing the thickness of glue sufficiently so that it does not accumulate on the pickers during intervals of nonlabeling, but without withholding all of the glue.

Figure 5:
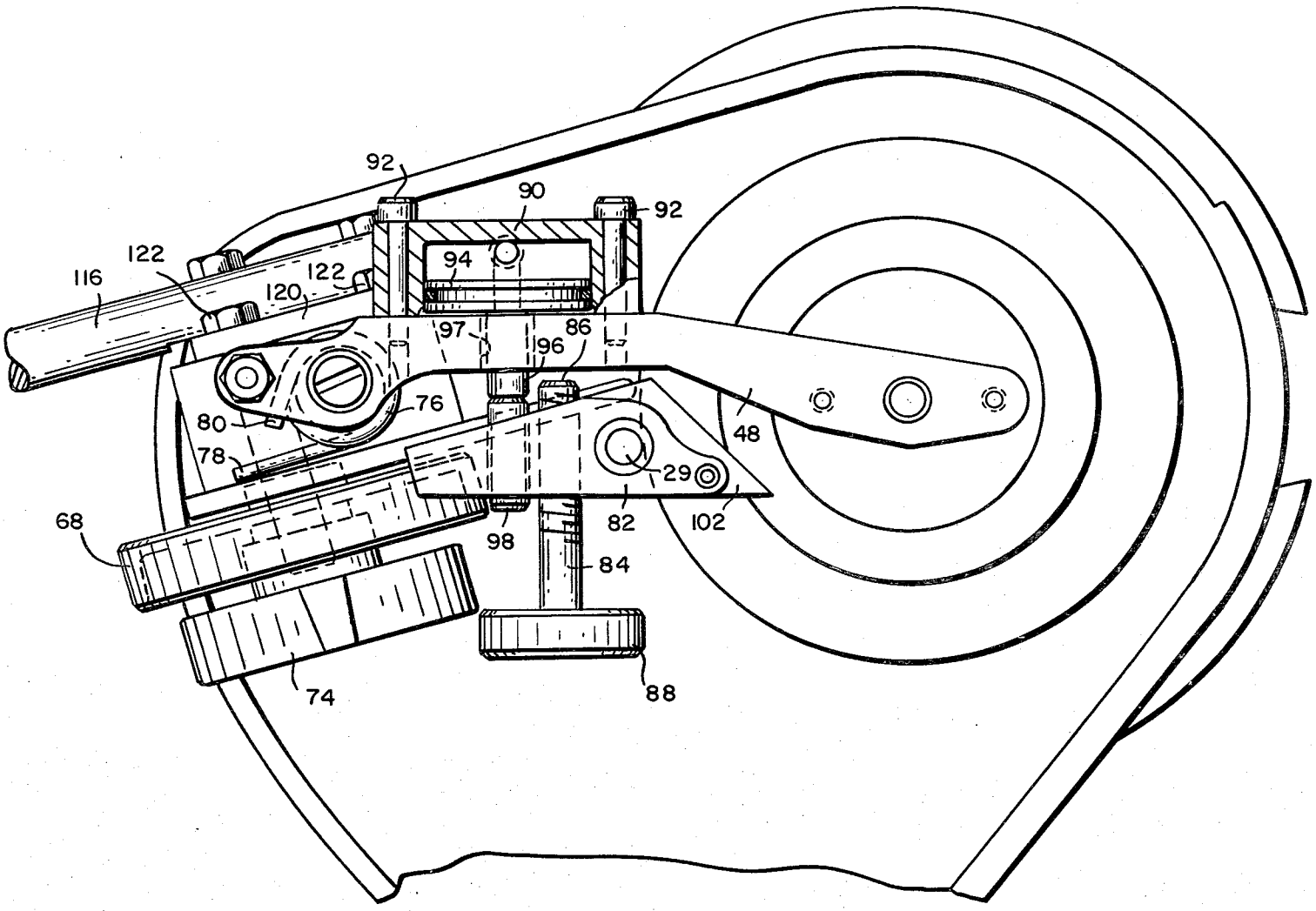
FIG. 5 is a plan view showing the doctor blade in close proximity to the surface of the glue applying roll.
Figure 6:
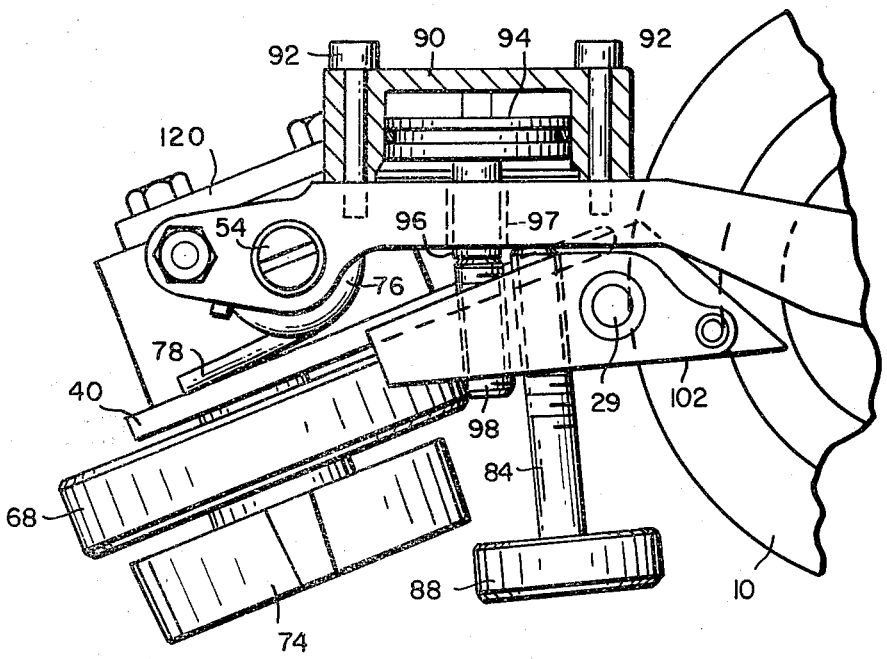
FIG. 6 is a plan view similar to FIG. 5 but with the glue receptacle at the bottom of the glue applying roll omitted showing the doctor blade spaced from the surface of the glue applying roll.

The glue applying roll and doctor blade assembly is shown in FIGS. 4 through 9 inclusive wherein the reference character 10 represents the glue applying roll and the reference character 22 represents the doctor blade assembly. The glue applying roll 10 has at its upper and lower ends members 24 and 26 which are fixed to a vertically disposed shaft 28, the lower end of which is rotatably mounted in a support structure 30 for rotation thereon and of the glue applying roll. A drive gear 32 is fixed to the lower end of the shaft 28 by means of which the shaft 28 is rotated. A tray 34 is mounted on the support structure 30 at the lower end of the glue applying roll into which glue gravitating downwardly on the surface of the glue applying roll can flow and be returned to a reservoir not shown for reuse. Glue is supplied to the peripheral surface of the glue applying roll at its upper end from a reservoir not shown through a flexible conductor by way of a port 29 which extends vertically downward through a scraper at the upper end of the glue roll as shown in FIGS. 5 and 6. Suitable bearings 36 and 38 are provided for rotatably receiving the lower end of the shaft 28 in the support structure 30.

Figure 7:
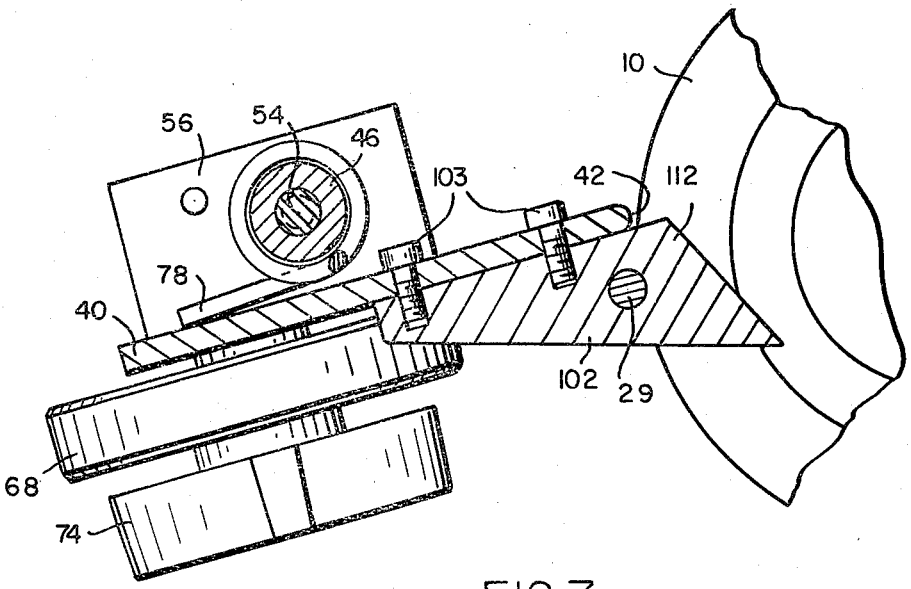
FIG. 7 is a fragmentary elevation with parts in section.
Figure 8:
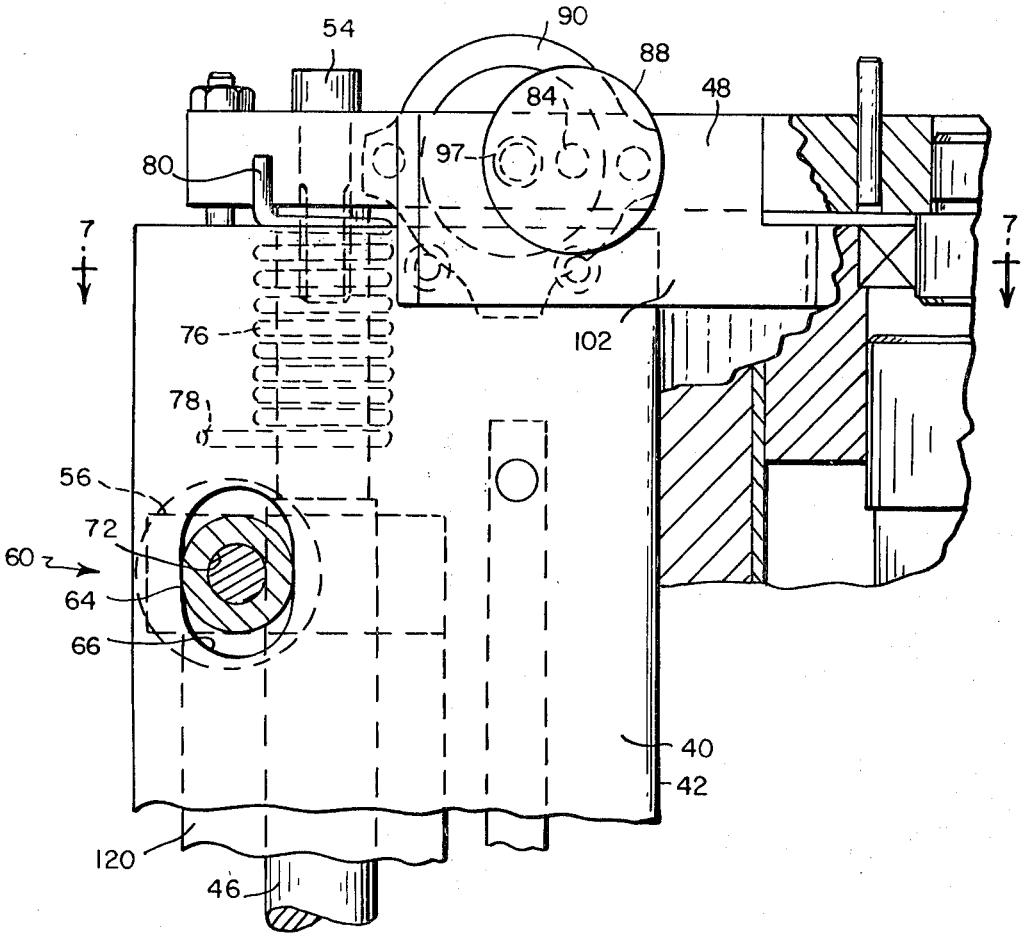
FIG. 8 is a fragmentary elevation of the upper part of the assembly with parts shown in elevation.
Figure 9:
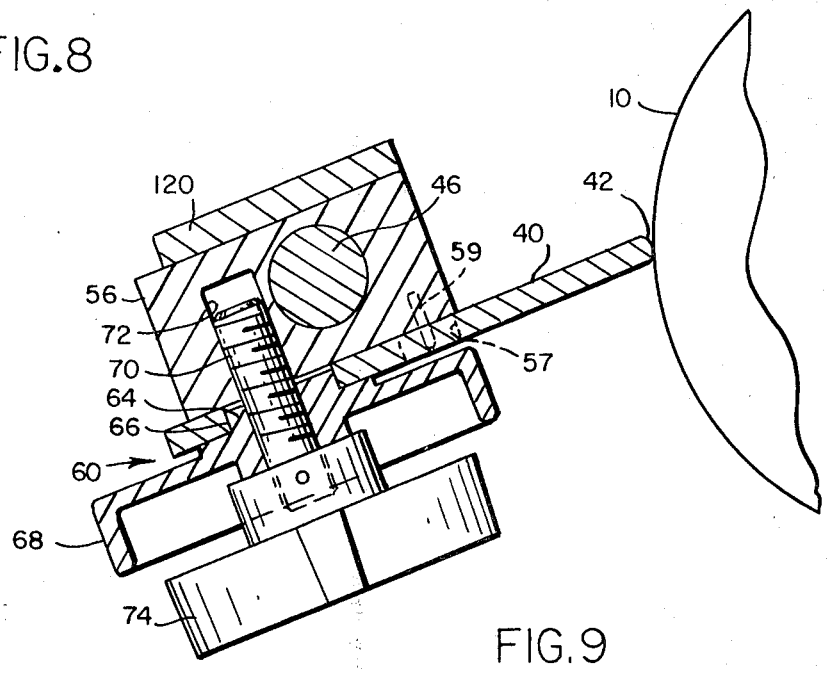
FIG. 9 is a horizontal section taken on the line 9—9 of FIG. 4.

The doctor blade assembly, FIGS. 7 and 9, comprises a doctor blade 40 which is a flat, elongate plate corresponding substantially in length to the axial length of the glue applying roll supported with an edge 42 adjacent the surface of the glue applying roll for movement from the position shown in FIG. 6 spaced from the surface sufficiently to provide enough glue for labeling to the position shown in FIG. 7 closer to the surface of the glue applying roll to reduce the glue to less than that required for labeling. For this purpose, there is provided a vertically disposed spindle 44, FIG. 4, fixed at its lower end to an arm 46 of the support structure 30 with its axis spaced from and parallel to the axis of the glue applying roll. The upperend of the spindle 44 is rigidly connected in spaced relation to the upper end of the glue applying roll by a rigid link 48 at one end of which there is a pin 50, the axis of which coincides with the axis of the glue applying roll and which is rotatably received within a bearing assembly 52 recessed into the upper end of the hub 24 and at the other end of which there is a bolt 54 which is screwed into the upper end of the spindle 44. A pair of blocks 56 and 58 are rotatably mounted on the spindle, one at the upper end and the other at the lower end and the doctor blade 40 is mounted to these blocks 56 and 58 by eccentric means 60 at the upper and lower ends. Each eccentric means, one of which is shown in FIG. 9, comprises an eccentric 64 situated within an opening 66 in the doctor blade and a wheel 68 by means of which it can be rotated to move the doctor blade 40 in a plane parallel to the axis of the glue applying roll. The eccentric is rotatably supported within the opening 66 by a threaded shaft 70 which is screwed into a threaded hole 72 in the block 56 or 58, as the case may be, and is provided at its outer end with a knob 74 which can be rotated relative to the wheel 68 to lock the latter in a predetermined position of rotation. The eccentric means provide for positioning the edge 42 of the doctor blade in exaxt parallelism with the surface of the glue applying roll. In order to maintain the vertical position of the blade with respect to the glue roll, the blade is provided with a slot 57 and the block 58 with a pin 59 which extends through the slot.

As indicated above, the doctor blade is designed to be moved from a first position for gauging the thickness of the adhesive on the surface of the glue applying roll for labeling to a second position to limit the thickness of the glue on the surface of the glue applying sufficiently so that an excess of glue will not be transferred to the pickers.

The doctor blade is held at the first position, as herein illustrated, by a coiled spring 76 disposed about the upper end of the spindle 46 with one end 78 bearing against the doctor blade rearwardly of the axis of the spindle and the other end 80 bearing against the link 48 rearwardly of the axis of the spindle so that the edge 42 of the doctor blade is biased in the direction away from the surface of the glue applying roll. To control the distance between the edge 42 of the doctor blade and the surface of the glue applying roll, a block 82 is bolted to the upper end of the doctor blade at substantially the level of the rigid link 48 and a screw 84 is threaded through this block so that one end 86 is opposite an edge of the rigid link 48. The other end has on it a knob 88 by means of which the screw may be rotated to vary the spacing between the end 86 and the link 48 and thus to control the distance that the doctor blade may move away from the surface of the glue applying roll under the biasing action of the spring 76.

To move the edge 42 of the doctor blade to the second position, a cylinder 90 is secured to the opposite side of the rigid link 48 by means of bolts 92–92 within which there is a piston 94 and from which protrudes a piston rod 96. The rod 96 extends through a hole 97 in the block. A threaded stud 98 is screwed into the block 82 in alignment with the rod 96 so that movement of the piston in the cylinder will effect movement of the block 82 through the intermediary of the stud 98 which, in turn, will effect movement of the edge of the doctor blade toward the surface of the glue applying roll. By adjusting the screw threaded stud 98, the distance between the edge of the doctor blade and the surface of the glue applying roll can be adjusted to maintain a minimal quantity of glue on the pickers at all times.

Figure 3:
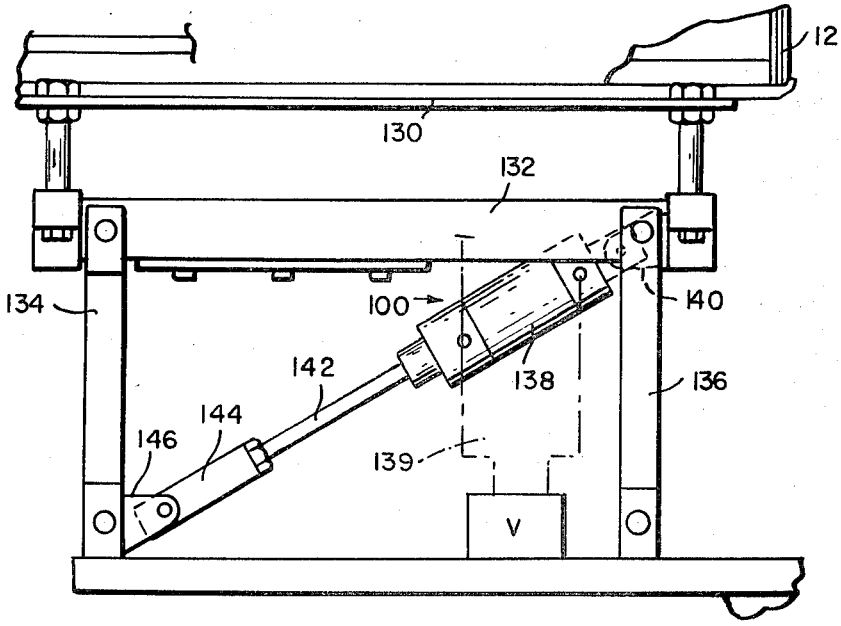
FIG. 3 is a fragmentary elevation to larger scale showing the mounting for the label magazine and means by which the label magazine may be retracted.
Figure 4:
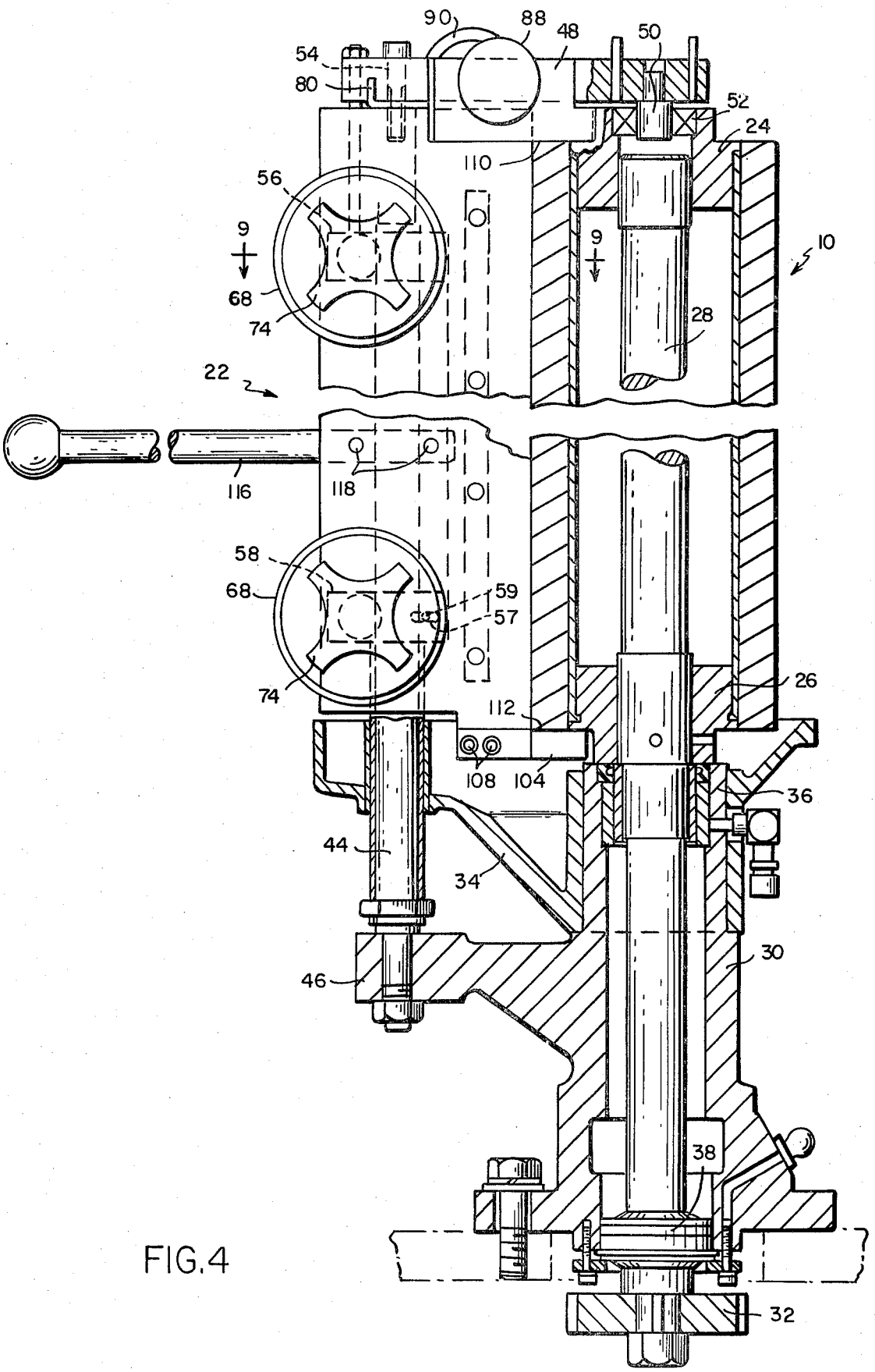
FIG. 4 is an elevation partly in section of a glue applying roll and doctor blade assembly.

Air is supplied to the cylinder 90 by means of a double acting valve V so arranged that when a sensing device S, FIG. 2, detects a gap in the procession of containers of more than X number of containers or a complete absence of containers, it will supply air pressure to a cylinder and piston assembly 100, FIG. 3, which is operably connected to the label magazine so as to retract the label magazine and simultaneously supply pressure to the cylinder 90 which moves the piston 94 in a direction toward the surface of the glue applying roll. As soon as the gap is closed or containers resume their flow, the valve V will be actuated to supply air to the piston which controls movement of the label magazine to move the latter back to its operative position and simultaneously to vent air from the cylinder 90, thus allowing the doctor blade to be moved away from the surface of the glue applying roll by the spring 76.

The magazine 12 is mounted for retraction from the path of travel of the picker shoes on a platform 130, FIG. 3, which is bolted to a frame 132, the latter being pivotally supported from the base of the apparatus by two pairs of legs 134,136 pivotally connected at their upper ends to the frame and at their lower ends to the base so that the frame can be moved laterally away from the picker while remaining parallel to the base. The piston and cylinder assembly 100 comprises a cylinder 138 pivtally connected at one end to a bracket member 140 at the upper ends of the legs 136–136 and a rod 142 adjustably connected by a threaded sleeve 144 to a bracket member 146 at the lower ends of the legs 134–134. By supplying air to the cylinder 138 in a direction to retract the rod, the frame supporting the magazine can be moved laterally away from the path of movement of the picker shoes. The cylinder 138 is double-acting so that when air is supplied to retract the piston rod, air will be exhausted from the opposite end of the cylinder and this air is supplied by a line 139 to the cylinder 90 to move the doctor blade toward the glue applying roll. When air is supplied to the cylinder 138 to advance the piston, air is exhausted from the cylinder 90 to allow the doctor blade to be moved away from the surface of the glue applying roll by means of the spring 76. A four-way valve is provided for controlling the supply of air to the cylinder 138.

It may be desirable to withdraw the doctor blade from surface of the glue applying roll before the label magazine is restored to its operative position in order to provide a thick coating of glue for application to the pickers just before the picking operation commences, otherwise there may not be enough glue to pick the labels. Hence, it is within the scope of the invention to delay movement of the label magazine back to its operative position until the glue applying roll has made several turns.

In addition to the doctor blade 40 which controls the thickness of the glue on the circumferential surface of the glue applying roll, there are doctor blades at the upper and lower ends of the glue applying rolls 102 and 104 located, respectively, at the top and bottom. The blades 102 and 104 are fastened by means of bolts 103, 108 to one side of the doctor blade 40 and have, respectively, scraping edges 110 and 112 which remove excess glue from the upper and lower ends of the glue applying roll.

To provide for manual movement of the doctor blade 40 away from the surface of the glue applying roll to clear the roll of labels which might become adhered thereto, there is provided a handle 116, one end of which is fastened by means of bolts 118–118 to a bar 120, the latter being bolted at its upper and lower ends respectively by means of bolts 122 to the blocks 56,58.

The doctor blade assembly as thus described is automatically effective to clear the glue applying roll of glue whenever there is a gap or absence in the procession of bottles or containers so that the machine may continue to run without becoming flooded with glue and so that the glue will be constantly returned to the reservoir of glue for continuous circulation to maintain it in a fluid condition for repeated use.

It should be understood that the present disclosure is for the purpose of illustration only and includes all modifications or improvements which fall within the scope of the appended claims.

This application is copending with Ser. No. 033,880 which shows a similar device.

I claim:

1. The combination with a glue applying roll, label magazine and picker, so arranged that the picker is movable in a path to first receive glue from the glue applying roll and then engage a label in the magazine, said label magazine being retractable from said path, of means for supplying glue to the glue applying roll so that it spreads over the surface thereof, a doctor blade supported adjacent the glue applying roll with an edge spaced from and parallel thereto, means for retracting the magazine and means operable simultaneously with the retraction of the magazine to move the doctor blade closer to the surface of the glue applying roll to prevent an accumulation of an excessive amount of glue on the picker.

2. Apparatus according to claim 1 wherein there is a piston connected to the magazine operable when air is supplied to one side thereof to retract the magazine, a piston connected to the blade for retracting and advancing the blade and means connecting the pistons so that when air is supplied to one piston to retract the magazine, air is supplied to the other piston to advance the blade and vice versa.

3. Apparatus according to claim 1 wherein there is means pivotally supporting the doctor blade, spring means yieldably biasing the doctor blade in a direction to urge the edge away from the surface of the glue applying roll and means for limiting said movement to a predetermined spacing from the surface of the glue applying roll.

4. Apparatus according to claim 3 wherein the means for limiting the spacing is adjustable.

5. The combination with a glue applying roll, label magazine and picker so arranged that the picker is movable in a path to first receive glue from the glue applying roll, pick a label from the magazine, and present it to a label transfer drum and wherein the label transfer drum removes the glue coated label from the picker and applies it to the container, a doctor blade assembly comprising a support supported for pivotal movement about an axis parallel to the axis of the glue applying roll, a doctor blade mounted to the support for pivotal movement therewith with an edge adjacent the surface of the glue applying roll, means on the support for adjusting the parallelism of the edge of the doctor blade relative to the surface of the glue applying roll, means for biasing the doctor blade about said axis away from the surface of the glue applying roll, means for controlling the proximity of the edge of the doctor blade to the surface of the glue applying roll and means for moving the edge of the doctor blade closer to the surface of the glue applying roll to reduce the layer of glue on the surface to a predetermined minimum without removing all of the glue.

6. The combination of a glue applying roll, a picker and a magazine from which labels are picked by the picker when the latter has on its surface a layer of glue, of a doctor blade supported with an edge in spaced, parallel relation to the surface of the glue applying roll and means operable to retract the label magazine from the path of movement of the picker and simultaneously to move the doctor blade closer to the surface of the glue applying roll to strip some but not all of the glue from the surface.

7. A glue control assembly for labeling machines wherein a picker is coated with glue for the purpose of removing labels from a label magazine and the label magazine is retractable relative to the picker, said assembly comprising a glue applying roll, doctor blade means pivotally supporting the doctor blade with an edge thereof parallel to the axis of rotation of the glue applying roll and for movement relative to the surface of the glue applying roll to in one position control the thickness of the glue on the surface of the glue applying roll and in the other position to scrape the glue from the surface of the glue applying roll, means yieldably biasing the doctor blade in a direction to hold said edge at a predetermined spacing from the surface of the glue applying roll and means operable when the label magazine is retracted to move the doctor blade into scraping engagement with the surface of the glue applying roll.

* * * * *